United States Patent [19]

Leifeld et al.

[11] Patent Number: 4,554,708

[45] Date of Patent: Nov. 26, 1985

[54] METHOD AND APPARATUS FOR SPRAYING TEXTILE FIBER BALES

[75] Inventors: Ferdinand Leifeld, Kempen; Rolf Coenen, Gronau-Epe; Werner Oelering, Gronau-Epe; Ludwig Klopp, Gronau-Epe, all of Fed. Rep. of Germany

[73] Assignee: Trützschler GmbH & Co. KG, Mönchengladbach, Fed. Rep. of Germany

[21] Appl. No.: 641,258

[22] Filed: Aug. 16, 1984

[30] Foreign Application Priority Data

Aug. 26, 1983 [DE] Fed. Rep. of Germany ..... 3330737

[51] Int. Cl.[4] ..... D01C 7/06; D01B 3/04

[52] U.S. Cl. ..... 19/80 R; 19/66 CC; 19/81

[58] Field of Search ..... 19/66 CC, 80 R, 81

[56] References Cited

U.S. PATENT DOCUMENTS

| | | | |
|---|---|---|---|
| 2,815,536 | 12/1957 | Bryant | 19/66 CC |
| 3,005,238 | 10/1961 | Manning | 19/80 R |
| 3,324,513 | 6/1967 | Hurdt | 19/66 CC |
| 3,802,030 | 4/1974 | Acref | 19/66 CC |
| 4,297,767 | 11/1981 | Leifeld | 19/80 R |

FOREIGN PATENT DOCUMENTS

| | | | |
|---|---|---|---|
| 0297717 | 5/1971 | U.S.S.R. | 19/81 |

*Primary Examiner*—Louis K. Rimrodt

*Attorney, Agent, or Firm*—Spencer & Frank

[57] ABSTRACT

A bale opener has a horizontally back-and-forth travelling assembly, including an opening device for progressively removing fiber material from a top surface of the bale during a working pass. The bale opener is combined with a spraying arrangement including a spraying nozzle mounted on the assembly for travel therewith as a unit. The spraying nozzle is oriented downwardly for discharging a downwardly directed fluid on the top surface of the bale during travel of the assembly.

10 Claims, 3 Drawing Figures

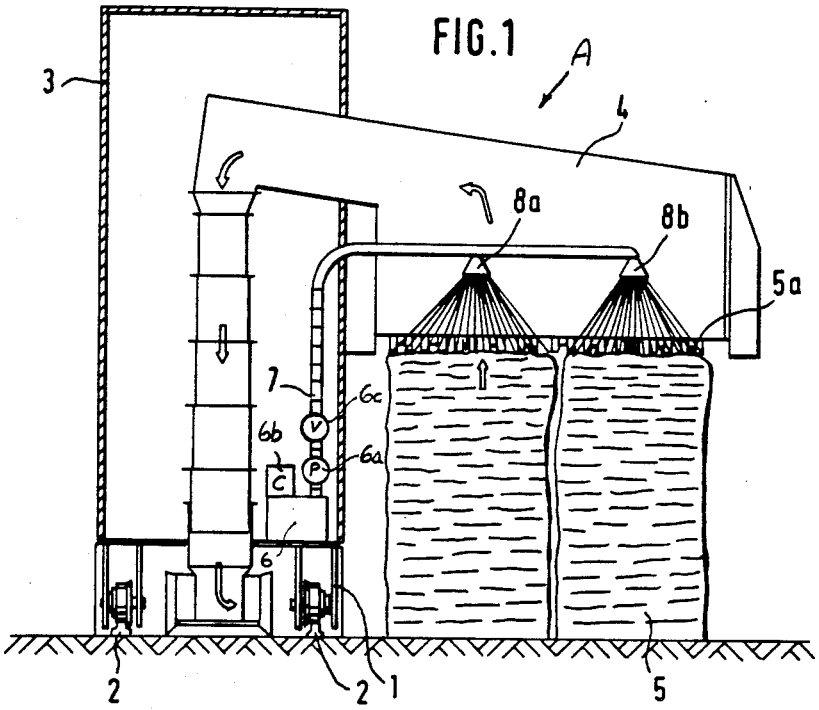
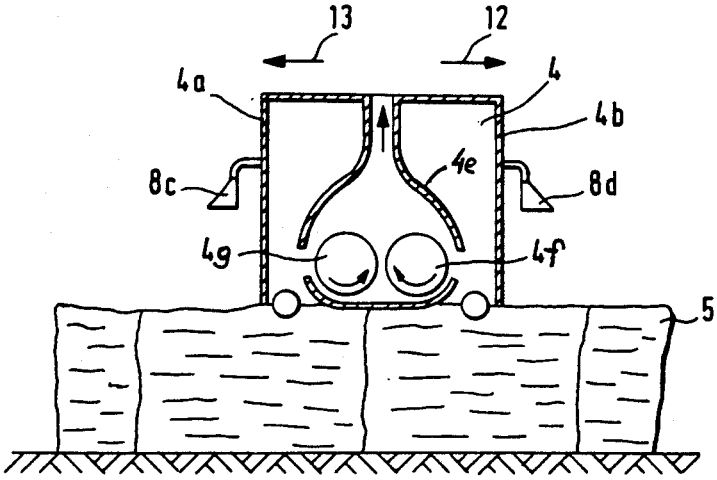
FIG.3

METHOD AND APPARATUS FOR SPRAYING TEXTILE FIBER BALES

BACKGROUND OF THE INVENTION

This invention relates to a method and an apparatus for spraying textile fiber bales such as cotton bales, with a liquid such as water, dye solutions, fiber treating agents or the like, wherein the liquid is taken from a reservoir through a conduit and the fiber bales are sprayed from above by means of a nozzle.

Liquids are sprayed on the upper face of fiber bales for various purposes such as moistening with water, marking with dye solutions and treating agents for enhancing processing of the fiber material, for example, solvents against honeydew. According to a known method, the liquids are sprayed from pipe conduits on conveyor belts. With this method, however, not only the textile material, but also the surrounding environment and machine components are exposed to the liquid. Damp and wet elements make the conveyance of the fiber material more difficult and the cleaning is circumstantial or not satisfactory which leads to disadvantages particularly when the type of material to be processed is changed. The time available to the liquid for acting upon the material is short: before the liquid can be absorbed or before it can penetrate into the inner material layers, the material is moved away and brought into contact with machine wall surfaces or guide elements. Thus, during such an occurrence, the fiber material loses significant amounts of surface moisture to the environment.

SUMMARY OF THE INVENTION

It is an object of the invention to provide an improved method and an apparatus of the above-outlined type from which the discussed disadvantages are eliminated and which ensures particularly a purposefully oriented and uniform spraying of the fiber material and an improved effect thereon.

This object and others to become apparent as the specification progresses, are accomplished by the invention, according to which, briefly stated, the nozzle travels together with the horizontally travelling structural components of a bale opener and the liquid is sprayed in a downward direction to impinge on the material vertically or at an oblique angle.

By providing that the nozzle travels together with the bale opener, the liquid is sprayed automatically and uniformly on the upper surface of the bale, and impinges continuously on a new upper surface as the bale opener removes fiber material from the bale top.

According to an advantageous feature of the invention, the liquid is sprayed on the material upstream of the travelling opening device (opening roller) as viewed in the direction of travel of the bale opener, so as to provide, until the successive pass of the opening device, sufficient time for the liquid to act upon the fiber material.

According to another preferred feature of the invention, the nozzle is secured to a cantilever of the bale opener which extends transversely over the fiber bales and which carries the opening elements. This arrangement ensures that the liquid is sprayed directly and with purposeful orientation, on the middle of the bales such that the environment will not be affected by liquid spray. Preferably, the nozzles are mounted on that side of the cantilever, which is upstream of the opening device as viewed in the working direction so that a dwelling and penetrating period for the liquid is provided for the stationarily supported fiber bales before the sprayed zones are removed during the successive pass of the opening device. Other spraying equipment, such as pump, compressor and reservoir are, according to a preferred embodiment of the invention, mounted on the moving (travelling) parts of the bale opener so that electric signals (activation and de-activation of spraying, pump operation and compressor operation) may be received directly from the control panel which travels with the apparatus, rather than over moving conduits. All travelling equipment may be arranged on a carriage which travels on rails, together with the travelling bale opener as a unit. Only the conduit for the spray material extending from the carriage to the nozzle need to be flexible since the opening devices vary their height level during operation. The carriage is preferably of the "tender" type which has the advantage that the equipment may be retrofitted without affecting any of the surrounding structure. This arrangement has all the advantages of a modular construction. Fiber bale sets (blocks) of different types of material may be sprayed with different liquids by providing several nozzles. Signals for spraying or not spraying as well as the selection of the type of spray material are derived from the available machine control and are triggered thereby. The spraying process may be initiated and terminated at the boundaries of the bale assembly, also sensed by the machine control for regulating the change of travelling direction of the opening devices. The start of the spraying operation is preferably so controlled that supply of the spraying material begins only when the nozzle is above the first bale of a bale series and the supply is stopped shortly before the nozzle leaves the last bale of the bale series.

BRIEF DESCRIPTION OF THE DRAWING

FIG. 1 is a schematic sectional rear elevational view of a preferred embodiment of the invention.

FIG. 3 is a schematic sectional side elevational view of another preferred embodiment of the invention.

DESCRIPTION OF THE PREFERRED EMBODIMENTS

Figure 2:
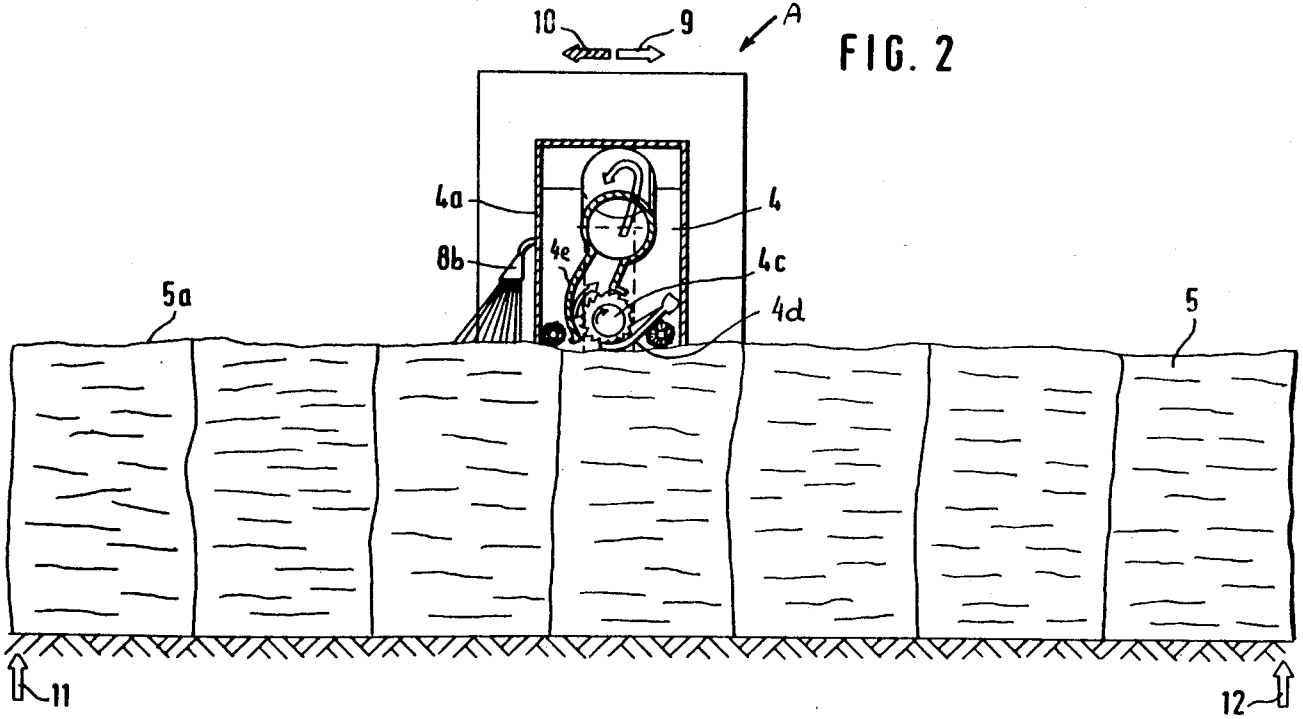
FIG. 2 is a schematic sectional side elevational view of the structure shown in FIG. 1.

Turning now to FIGS. 1 and 2, there is illustrated a travelling bale opener generally designated at A which may be, for example, a "Blendomat" model manufactured by Trützschler GmbH & Co. KG, Mönchengladbach, Federal Republic of Germany. The bale opener comprises a frame structure 1 which travels on rails 2. The frame structure 1 supports a tower 3 which has a laterally extending cantilever 4 carrying a bale opening assembly which includes a saw-toothed opening roller **4*c*, a grate 4*d* and a suction hood 4*e* for removing the material taken by the opening roller 4*c* from a series of bales 5. The latter may be arranged in two side-by-side rows extending adjacent and parallel to the rails 2**. Expediently, the floor areas where the bales are to be positioned are being marked.

On the machine frame 1 there is mounted a reservoir 6 which contains the liquid to be sprayed. With the reservoir 6 there are associated auxiliary liquid dispensing devices, such as a pump **6*a*, a compressor 6*b*, and valves 6*c* also mounted on the machine frame 1 and shown symbolically. From the reservoir, or the pump 6***a* drawing liquid therefrom, there extends a conduit 7 which, at its other end is provided with two nozzles 8*a* and 8*b* spaced transversely to the direction of travel. The latter are secured to a lateral face 4*a* of the cantilever 4. The outlet of the nozzles 8*a* and 8*b* is oriented towards the surface 5*a* of the fiber bales 5.

Turning now to FIG. 2, the working direction of the bale opener is indicated by an arrow 9. During the working pass in the direction of arrow 9 fiber tufts are torn by the opening roller 4*c* from the top surfaces of consecutive bales 5. The arrow 10 indicates a return travel (idling run) of the bale opener. The nozzles 8*a* and 8*b* are secured to the upstream lateral face 4*a* of the cantilever 4, as viewed in the direction of the working pass. Thus, the nozzles 8*a* and 8*b* travel together with the horizontally moving cantilever 4, while liquid is sprayed vertically or at an inclined angle on the upper face 5*a* of the fiber bales 5. Stated differently, as viewed in the direction of the working pass 9 of the bale opener, the liquid is sprayed on the bales upstream of the cantilever 4.

FIG. 2 symbolically illustrates two switching elements 11 and 12 at opposite ends of the fiber bale series. These switches are connected with a drive control for the bale opener as well as with control devices for the valves for controlling the liquid supply equipment (such as the reservoir 6, the pump and the compressor). This arrangement ensures that the beginning and the end of a working pass as well as the spraying operation is controlled dependent upon the location of the opposite ends of the fiber bale series.

Turning now to FIG. 3, the cantilever 4 carries a pair of saw-toothed opening rollers 4*f* and 4*g*. The arrows 12 and 13 indicate oppositely oriented working passes. Thus, in this arrangement fiber tufts are being removed from the upper face of the fiber bales in both directions of opener travel. On the lateral cantilever face 4*a* there is mounted a nozzle 8*c* whereas to the opposite lateral cantilever face 4*b* a nozzle 8*d* is secured. Expediently, the nozzles 8*c* and 8*d* are operated such that the liquid is sprayed upstream of the cantilever 4 in each instance as viewed in the direction 12 or 13 of the then performed working pass. Upon reversal of the travelling direction, supply of liquid for the nozzles 8*c* and 8*d* is switched, so that expediently only the nozzle 8*c* or the nozzle 8*d* is operative while the other nozzle 8*c* or 8*d* idles.

It will be understood that the above description of the present invention is susceptible to various modifications, changes and adaptations, and the same are intended to be comprehended within the meaning and range of equivalents of the appended claims.

What is claimed is:

1. In a method of spraying textile fiber bales with a liquid, including the steps of drawing the liquid from a reservoir through a conduit and ejecting the liquid from a spraying nozzle downwardly onto the bales; the improvement comprising the steps of opening the bales from the top in consecutive working passes by a back-and-forth travelling bale opener; effecting travel of the nozzle together with said bale opener; and spraying top faces of the bales through said nozzle during said travel.

2. A method as defined in claim 1, wherein the bale opener has a travelling opening device; and further wherein the spraying step comprises the step of spraying the top faces of the bales upstream of the opening device as viewed in the direction of the working pass.

3. In a bale opener, having a horizontally back-and-forth travelling assembly, including an opening device for progressively removing fiber material from a top surface of the bale during a working pass; the improvement comprising the combination of said bale opener with a spraying means, including a spraying nozzle mounted on said assembly for travel therewith as a unit; said spraying nozzle being oriented downwardly for discharging a downwardly directed fluid on the top surface of the bale during travel of the assembly.

4. A bale opener as defined in claim 3, wherein said assembly includes a tower and a cantilever supported by the tower and extending generally horizontally transversely to the direction of travel of said assembly; said cantilever carrying said opening device and said spraying nozzle.

5. A bale opener as defined in claim 4, wherein said cantilever has a side extending generally perpendicularly to said direction of travel and is situated upstream of said opening device as viewed in the direction of the working pass; said spraying nozzle being mounted on said side.

6. A bale opener as defined in claim 3, wherein said spraying means comprises a reservoir, a conduit having an end connected to said spraying nozzle, a pump connected to said reservoir and said conduit for drawing liquid from the reservoir and driving the liquid through the conduit to the spraying nozzle, and valve means for controlling the liquid; said reservoir, said pump, said conduit and said valve means being mounted on said assembly.

7. A bale opener as defined in claim 3, wherein said spray nozzle is present in a plurality.

8. A bale opener as defined in claim 7, further comprising means for supplying all the spray nozzles with the same liquid.

9. A bale opener as defined in claim 7, further comprising means for supplying different nozzles with different liquids.

10. A bale opener as defined in claim 3, further comprising first control means for controlling the operation of said bale opener and second control means for controlling the operation of said spraying nozzle and means operatively coupling said first and second control means to one another for coordinating a timing of a spraying operation with the beginning and stopping of the opening operation during each working pass.

* * * * *